US012264417B2

(12) United States Patent
Xu et al.

(10) Patent No.: US 12,264,417 B2
(45) Date of Patent: Apr. 1, 2025

(54) ANTI-BACTERIAL FIBERS

(71) Applicant: HONEYWELL INTERNATIONAL INC., Charlotte, NC (US)

(72) Inventors: Jing Xu, Charlotte, NC (US); Rui Luo, Charlotte, NC (US); Lei Han, Charlotte, NC (US); Jun Li, Charlotte, NC (US)

(73) Assignee: Honeywell International Inc., Charlotte, NC (US)

( * ) Notice: Subject to any disclaimer, the term of this patent is extended or adjusted under 35 U.S.C. 154(b) by 1014 days.

(21) Appl. No.: 17/105,046

(22) Filed: Nov. 25, 2020

(65) Prior Publication Data

US 2021/0198814 A1 Jul. 1, 2021

(30) Foreign Application Priority Data

Nov. 29, 2019 (CN) ..... 201911202188.7

(51) Int. Cl.

| | |
|---|---|
| ***D01F 8/06*** | (2006.01) |
| ***D01D 5/06*** | (2006.01) |
| ***D01D 10/02*** | (2006.01) |

(52) U.S. Cl.

CPC ..... *D01F 8/06* (2013.01); *D01D 5/06* (2013.01); *D01D 10/02* (2013.01); *D10B 2321/0211* (2013.01); *D10B 2401/13* (2013.01)

(58) Field of Classification Search

CPC . D01F 8/06; D01D 5/06; D01D 10/02; D01B 2321/0211; D01B 2401/13; D10B 2321/0211; D10B 2401/13

(Continued)

(56) References Cited

U.S. PATENT DOCUMENTS

2007/0059347 A1 3/2007 Suzuki et al.
2008/0139441 A1* 6/2008 Xiao ..... A01N 47/44 510/319

(Continued)

FOREIGN PATENT DOCUMENTS

AU 2008240809 A1 10/2008
CN 109440211 A 3/2019

(Continued)

OTHER PUBLICATIONS

Extended European Search Report issued in European Application No. 20208680.7 on Mar. 31, 2021, 8 pages.

(Continued)

*Primary Examiner* — Lynda Salvatore
(74) *Attorney, Agent, or Firm* — Alston & Bird LLP

(57) ABSTRACT

Apparatuses and associated methods of manufacturing are described that provide for an anti-bacterial fiber. The method of manufacturing includes adding a ultra-high molecular weight polyethylene structure into an extrusion device. The method of manufacturing also includes providing an anti-bacterial low-density polyethylene (LDPE) into the ultra-high molecular weight polyethylene at a predetermined temperature to create a combined filament. The method of manufacturing further includes passing the combined filament through a bath. The bath is configured for coagulating the combined filament and extracting a solvent. The method of manufacturing still further includes drying the combined filament via an oven. The method of manufacturing also includes hot-drawing the combined filament. The combined filament is heated during the hot-drawing within the oven and the combined filament generated has anti-bacterial qualities. A corresponding anti-bacterial fiber is also provided.

10 Claims, 6 Drawing Sheets

(58) Field of Classification Search
USPC ..... 428/357
See application file for complete search history.

(56) References Cited

U.S. PATENT DOCUMENTS

| | | | | |
|---|---|---|---|---|
| 2010/0136073 | A1 | 6/2010 | Preuss et al. | |
| 2011/0238092 | A1 | 9/2011 | Vaz et al. | |
| 2014/0065913 | A1* | 3/2014 | Klein | D06B 1/00 427/535 |

FOREIGN PATENT DOCUMENTS

| | | | |
|---|---|---|---|
| CN | 109468700 | A | 3/2019 |
| CN | 109868518 | A | 6/2019 |
| KR | 10-2012-0122822 | A | 11/2012 |

OTHER PUBLICATIONS

Wang Hao et al. "Preparation and Properties of Nonleaching Antimicrobial Linear Low-Density Polyethylene Films," Ind. Eng. Chem. Res. 2015, 54, 6, 1824-1831. https://doi.org/10.1021/ie504393t.

Wang Yue et al. "Polypropylene-Grafted Poly(hexamethylene guanidine)/Modified Polyethylene Monofilament and Its Antimicrobial Performance", International Journal of Polymer Science, vol. 2020, Article ID 6416230, 8 pages, 2020. https://doi.org/10.1155/2020/6416230.

Intention to grant Mailed on Oct. 24, 2023 for EP Application No. 20208680, 9 page(s).

CN Office Action Mailed on Dec. 5, 2023 for CN Application No. 201911202188, 8 page(s).

English Translation of CN Office Action dated Dec. 5, 2023 for CN Application No. 201911202188, 7 page(s).

Decision to grant a European patent Mailed on Feb. 29, 2024 for EP Application No. 20208680, 2 page(s).

CN Office Action Mailed on Aug. 24, 2024 for CN Application No. 201911202188, 5 page(s).

English Translation of CN Office Action dated Aug. 24, 2024 for CN Application No. 201911202188, 8 page(s).

CN Office Action Mailed on Nov. 7, 2024 for CN Application No. 201911202188, 5 page(s).

English Translation of CN Office Action dated Nov. 7, 2024 for CN Application No. 201911202188, 2 page(s).

* cited by examiner

ANTI-BACTERIAL RATIO: 96.6%

ANTI-BACTERIAL FIBERS

TECHNOLOGICAL FIELD

Example embodiments of the present application relate generally to high performance materials, and, more particularly, to anti-bacterial high performance material structures and composites.

BACKGROUND

Most personal protective equipment is typically made of ultra-high molecular weight polyethylene which does not have anti-bacterial properties. Ultra-high molecular weight polyethylene is normally positioned near skin and can become itchy and/or smelly due to bacteria growth. Current methods of producing bacteria resistant materials includes dipping gloves in anti-bacterial additives, like Ag and Ag+, quaternary ammonium compounds, or other agents. However, the anti-bacterial performance of dipped materials is impermanent and adds additional steps of manufacturing gloves. Additionally, the bacteria resistance and longevity of dipped materials are often different on different material. Additionally, treatment process is complex and pollution created to produce the bacteria resistant material.

Applicant has identified a number of deficiencies and problems associated with high performance material structures data. Through applied effort, ingenuity, and innovation, many of these identified problems have been solved by developing solutions that are included in embodiments of the present disclosure, many examples of which are described in detail herein.

BRIEF SUMMARY

Example embodiments of the present disclosure are directed to a cut-resistant high-bacterial resistance fiber structure and associated methods of manufacturing. In an example embodiment, an anti-bacterial fiber is provided. The anti-bacterial fiber includes an ultra-high molecular weight polyethylene structure. The anti-bacterial fiber also includes an anti-bacterial low-density polyethylene (LDPE). The anti-bacterial LDPE includes polyhexamethylene guanidine (PHMG) grafted to a LDPE structure. The ultra-high molecular weight polyethylene structure and the anti-bacterial LDPE are combined together to form the anti-bacterial fiber.

In some embodiments, the anti-bacterial low-density polyethylene is dissolved in an oil. In some embodiments, the oil that the anti-bacterial low-density polyethylene is dissolved includes coal oil. In some embodiments, a weight of the anti-bacterial LDPE is approximately 1% of the total weight of the anti-bacterial fiber. In some embodiments, the ultra-high molecular weight polyethylene and the anti-bacterial LDPE are combined using gel-spinning. In some embodiments, a weight of the anti-bacterial LDPE is 0.5% to 10% of the total weight of the anti-bacterial fiber.

In some embodiments, the ultra-high molecular weight polyethylene structure is extruded through an extrusion device. In some embodiments, the ultra-high molecular weight polyethylene structure is extruded through an extrusion device before being combined with the anti-bacterial LDPE. In some embodiments, the ultra-high molecular weight polyethylene structure and the anti-bacterial LDPE are extruded through a moderated flow device. In some embodiments, the anti-bacterial fiber is configurable into a clothing material.

In another example embodiment, a method of manufacturing an anti-bacterial fiber is provided. The method includes adding a ultra-high molecular weight polyethylene structure into an extrusion device. The method also includes providing an anti-bacterial low-density polyethylene (LDPE) into the ultra-high molecular weight polyethylene at a predetermined temperature to create a combined filament. The method further includes passing the combined filament through a bath. The bath is configured for coagulating the combined filament and extracting a solvent. The method still further includes drying the combined filament via an oven. The method also includes hot-drawing the combined filament. The combined filament is heated during the hot-drawing within the oven and the combined filament generated has anti-bacterial qualities.

In some embodiments, the predetermined temperature is approximately 80 degrees Celsius to 200 degrees Celsius. In some embodiments, the predetermined temperature is approximately 105 degrees Celsius. In some embodiments, the anti-bacterial LDPE provided to the extruded ultra-high molecular weight polyethylene is dissolved into an oil. In some embodiments, the oil that the anti-bacterial low-density polyethylene is dissolved includes coal oil. In some embodiments, a weight of the anti-bacterial LDPE is approximately 1% of the total weight of the anti-bacterial fiber. In some embodiments, a weight of the anti-bacterial LDPE is 0.5% to 10% of the total weight of the anti-bacterial fiber.

In some embodiments, the method also includes extruding the ultra-high molecular weight polyethylene structure and the anti-bacterial LDPE through a moderated flow device. In some embodiments, the high-density polyethylene is extruded through an extrusion device before being combined with the anti-bacterial LDPE. In some embodiments, the method also includes threading the anti-bacterial fiber together to form an anti-bacterial clothing material.

The above summary is provided merely for purposes of summarizing some example embodiments to provide a basic understanding of some aspects of the invention. Accordingly, it will be appreciated that the above-described embodiments are merely examples and should not be construed to narrow the scope or spirit of the invention in any way. It will be appreciated that the scope of the invention encompasses many potential embodiments in addition to those here summarized, some of which will be further described below.

BRIEF DESCRIPTION OF THE DRAWINGS

Having described certain example embodiments of the present disclosure in general terms above, reference will now be made to the accompanying drawings. The components illustrated in the figures may or may not be present in certain embodiments described herein. Some embodiments may include fewer (or more) components than those shown in the figures.

DETAILED DESCRIPTION

Overview

The present invention now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout. As used herein, terms such as "front," "rear," "top," etc. are used for explanatory purposes in the examples provided below to describe the relative position of certain components or portions of components. Furthermore, as would be evident to one of ordinary skill in the art in light of the present disclosure, the terms "substantially" and "approximately" indicate that the referenced element or associated description is accurate to within applicable engineering tolerances.

The term "comprising" means including but not limited to, and should be interpreted in the manner it is typically used in the patent context. The phrases "in one embodiment," "according to one embodiment," and the like generally mean that the particular feature, structure, or characteristic following the phrase may be included in at least one embodiment of the present invention, and may be included in more than one embodiment of the present invention (importantly, such phrases do not necessarily refer to the same embodiment). If the specification describes something as "exemplary" or an "example," it should be understood that refers to a non-exclusive example.

As discussed herein, example embodiments may be described with reference to a fiber structure that includes various cores, filaments, yarns, coverings, and the like. In this regard, the fiber structure as described and claimed may, in some examples, refer to a composite fiber structure. For the sake of clarity of description, example embodiments of the present application are herein described with reference to an "anti-bacterial fiber", but may equally and interchangeably refer to composite anti-bacterial fiber structures. The term anti-bacterial may indicate a substantial reduction in bacteria, may indicate a complete reduction and/or elimination of bacteria, may indicate a fiber that is active against bacteria, and/or the like. Various embodiments of the present disclosure allow for a material that has anti-bacterial qualities without expensive manufacturing and/or additional steps (e.g., coating or the like). For example, some gloves currently in use anti-bacterial coating of traditional gloves in order to reduce the bacteria, but this method is both impermanent and adds additional steps to the manufacturing process.

Figure 1:
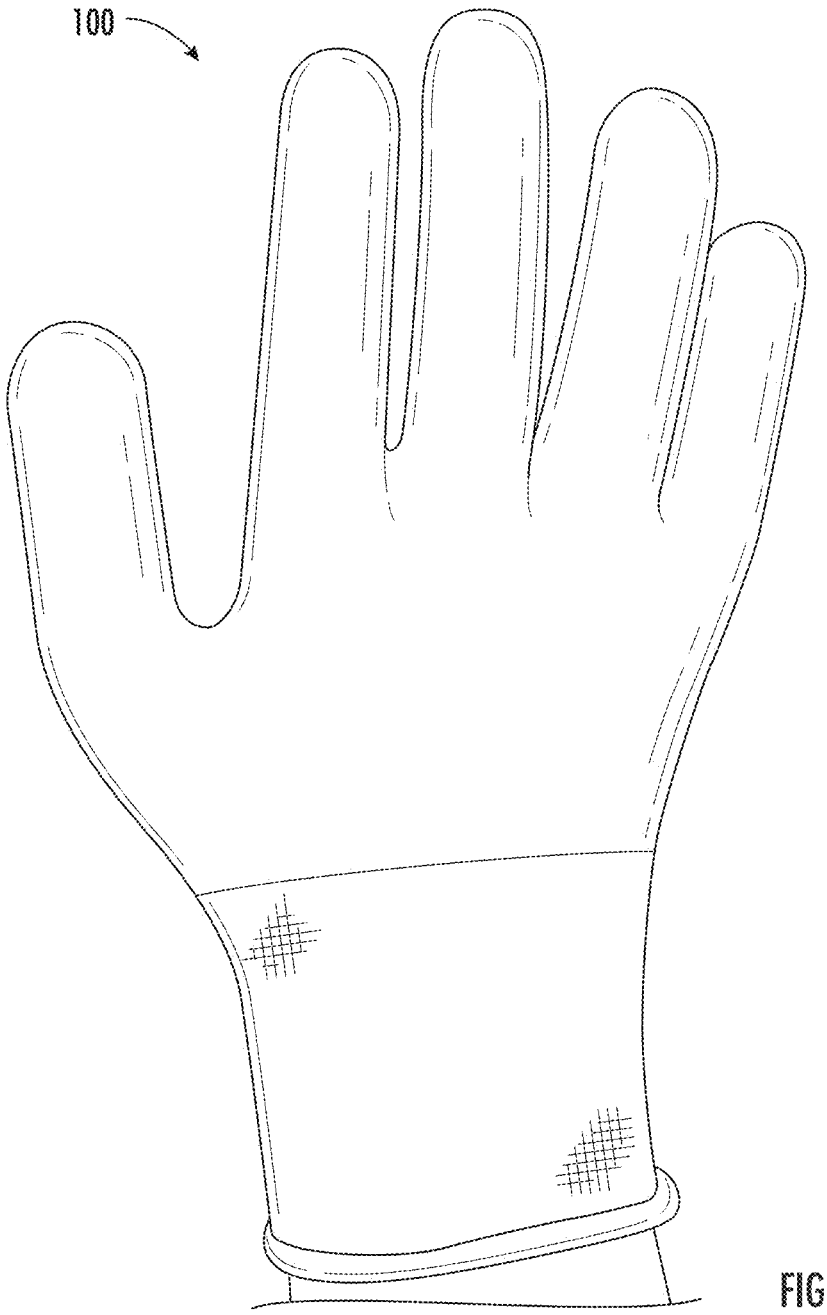
FIG. 1 illustrates example anti-bacterial fiber structures of the present disclosure implemented in an example anti-bacterial glove.

With reference to FIG. 1, an anti-bacterial glove 100 implementing and/or otherwise composed of an example anti-bacterial fiber is illustrated. As shown, the anti-bacterial glove 100 may be manufactured or otherwise formed of anti-bacterial fiber manufactured in line with an example embodiments discussed herein. For example, the anti-bacterial fiber may be used to create yarn that is used to manufacture an anti-bacterial cloth configured for clothing fabrics or the like.

Figure 3:
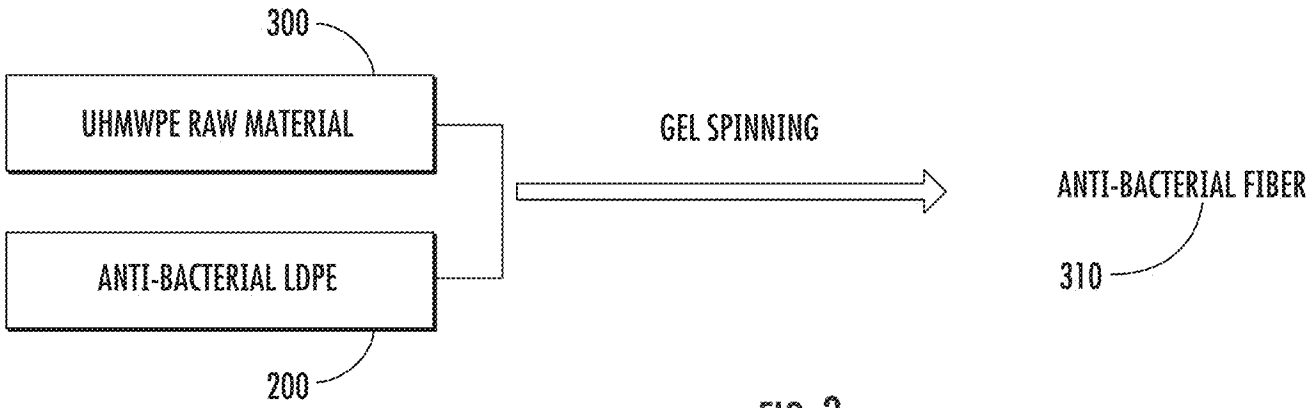
FIG. 3 illustrates a simplified method of manufacturing to produce an anti-bacterial fiber in accordance with the present disclosure.
Figure 4:
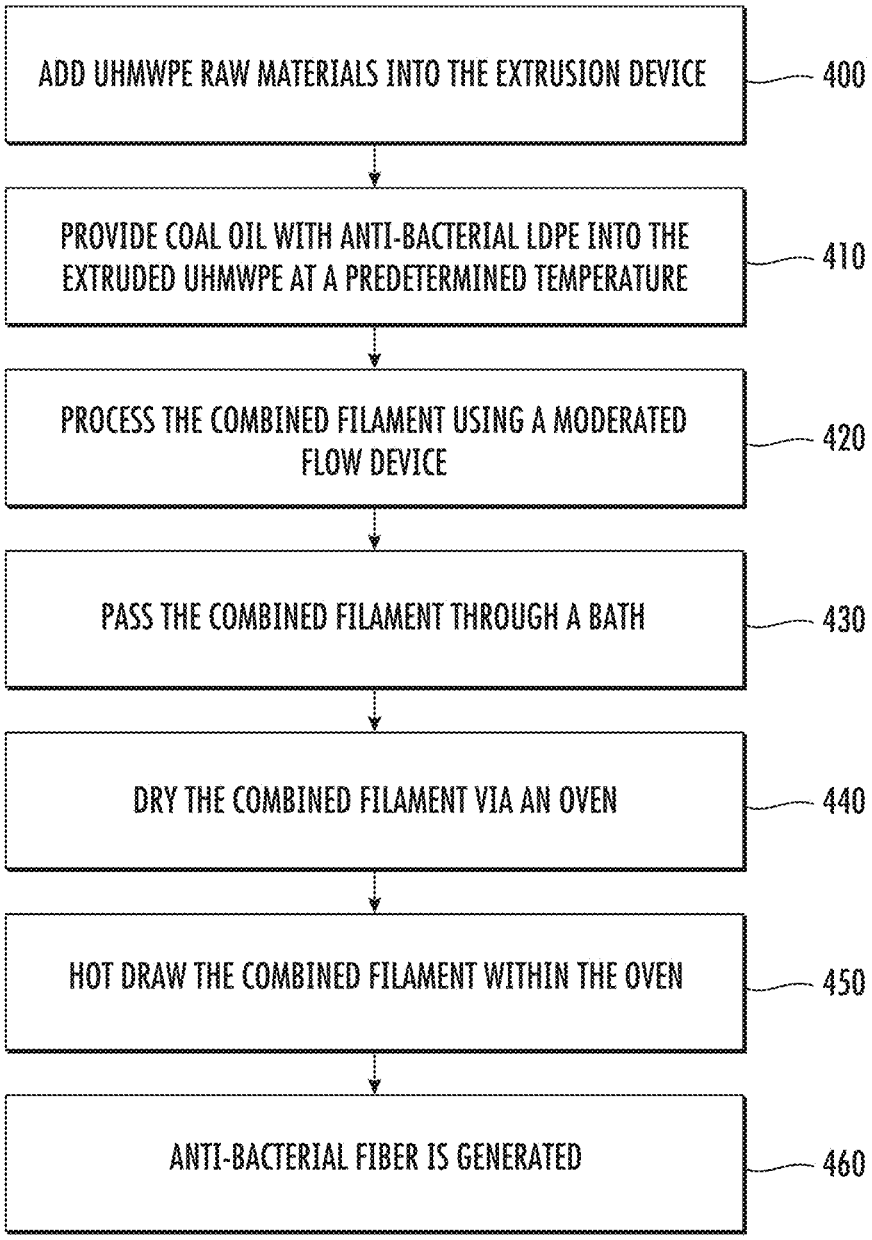
FIG. 4 is a flowchart that illustrates an example method of manufacturing the anti-bacterial fiber in accordance with an example embodiment of the present disclosure.
Figure 5:
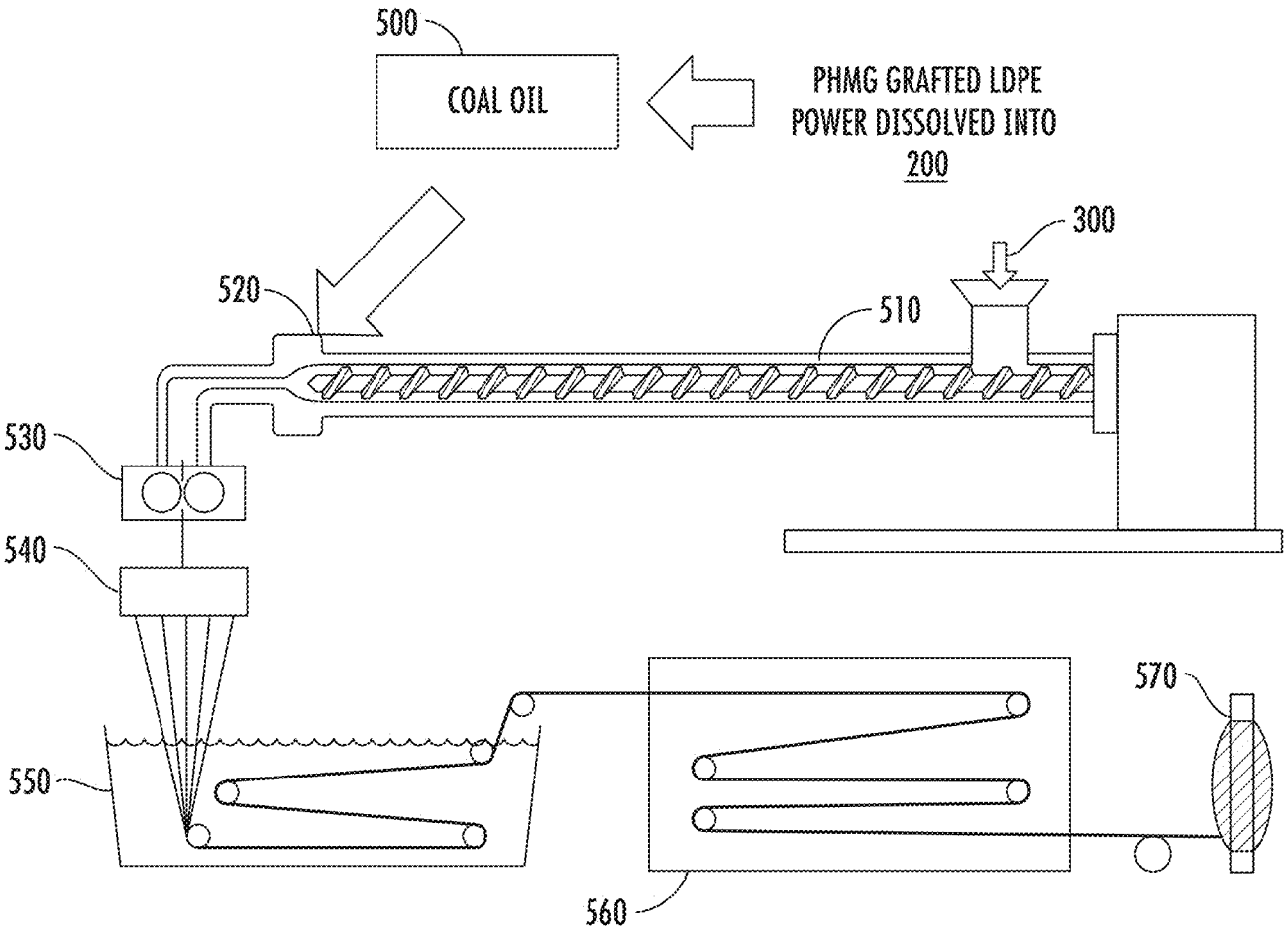
FIG. 5 illustrates an example method of manufacturing, such as the one discussed in FIG. 4, the anti-bacterial fiber in accordance with an example embodiment of the present disclosure.

As described hereafter with reference to FIGS. 3-5, the anti-bacterial fiber of the present application may be created from combining high-density polyethylene, such as an ultra-high molecular weight polyethylene (UHMWPE) raw material, with anti-bacterial low-density polyethylene (LDPE) (e.g., the anti-bacterial LDPE is formed from PHMG being grafted with LDPE). While the present disclosure may refer to high-density polyethylene in connection with UHMWPE, other high-density polyethylene structures may be contemplated.

Though predominately discussed in reference to gel-spinning, the high-density polyethylene and the anti-bacterial LDPE may be combined using various spinning techniques, such as dry spinning, wet spinning, or the like. While illustrated and described with reference to anti-bacterial fiber structures used in forming an anti-bacterial glove 100, the present disclosure contemplates that the anti-bacterial fiber structures described herein may equally be used to form any garment (e.g., pants, shirts, jackets, coverings, or the like) without limitation. In some embodiments, the anti-bacterial fiber may have a light color (e.g., the anti-bacterial fiber may be slightly yellow), allowing the anti-bacterial fiber to be dyed various colors for use.

Figure 2:
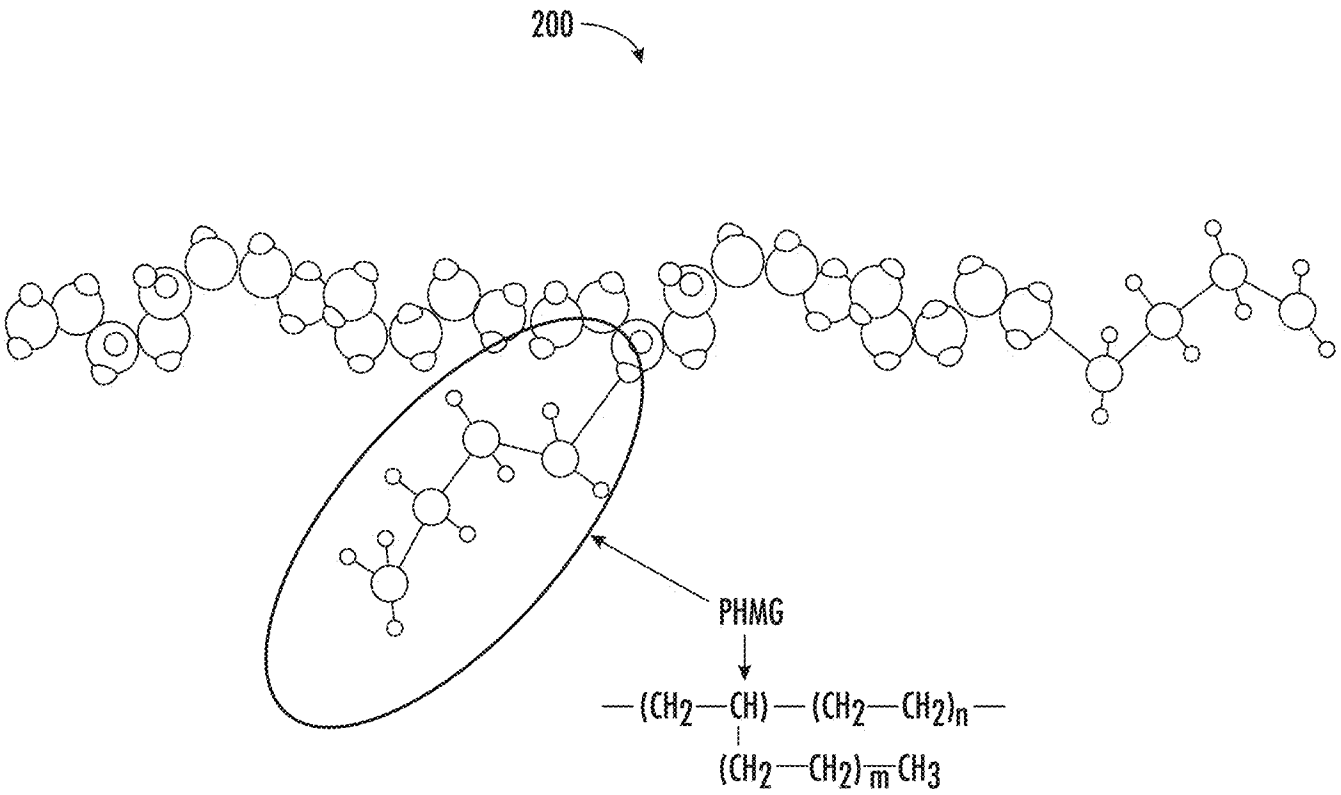
FIG. 2 illustrates an example anti-bacterial low density polyethylene created by grafting PHMG with low-density polyethylene to be used in combination with other polyethylene structures in accordance with an example embodiment of the present disclosure.

Referring now to FIG. 2, an example anti-bacterial LDPE is shown in accordance with an example embodiment. As shown, PHMG is grafted to the LDPE to form the anti-bacterial LDPE 200 discussed herein. In various embodiments, the PHMG structure may be $(C_7H_{15}N_3)_n$ and may be configured to be grafted to LDPE to create an anti-bacterial LDPE structure discussed here.

Referring now to FIG. 3, a simplified method of manufacture of the anti-bacterial fiber is shown. As shown, the anti-bacterial fiber discussed in reference to FIG. 1 above may be manufactured by gel spinning the UHMWPE raw materials and anti-bacterial LDPE (i.e., PHMG grafted with LDPE) to produce the anti-bacterial UHMWPE filament (e.g., the anti-bacterial fiber). In some embodiments, the amount of anti-bacterial LDPE may vary based on the amount of bacterial resistance desired, the desired cost, or the like. In some embodiments, the anti-bacterial LDPE may be approximately 0.5% to 10% of the total weight of the anti-bacterial fiber. In some embodiments, the anti-bacterial LDPE may be approximately 0.75% to 3% of the total weight of the anti-bacterial fiber. In some embodiments, the anti-bacterial LDPE may be approximately 0.8% to 1.5% of the total weight of the anti-bacterial fiber. In some embodiments, the anti-bacterial LDPE may be approximately 1% of the total weight of the anti-bacterial fiber.

FIG. 4 illustrates an example method of manufacture is shown in accordance with an example embodiment. Various embodiments of the method described may be carried out in a different order than described herein, unless explicitly stated otherwise. Additional operations may also be completed during the method of manufacturing an anti-bacterial fiber, therefore the following steps are not exhaustive.

Referring now to Block 400 of FIG. 4, the method of manufacture includes adding a ultra-high molecular weight polyethylene (e.g., a polyethylene with an average viscosity molecular weight in the range of $1\times10^6$–$2\times10^7$ grams/mol) structure into the extrusion device. In some embodiments, the UHMWPE may be added into the extrusion device using a mixing vessel or the like. In some embodiments, the mixing vessel may include an agitator (e.g., agitator blades or the like). In some embodiments, UHMWPE may be combined with one or more additional substances (e.g., the UHMWPE may be suspended in a first solvent, such as white oil or chloro-fluoro alkane, and in some cases, additional substances, such as a surfactant, dispersing agent) to form a UMWPE solution in order to assist the extrusion process. In various embodiments, the UHMWPE structure may be suspended into a non-volatile first solvent at a given concentration. In some embodiments, the UHMWPE concentration may be approximately 5% to 20% of the UMWPE solution, preferably approximately 6% to 15% of the UMWPE solution, and more preferably approximately 8% of the UMWPE solution. In various embodiments, the extrusion device 510 may be a twin-screw configured to rotate during operation. In some embodiments, the extrusion device 510 may also heat the UHMWPE raw materials during operation.

Referring now to Block 410 of FIG. 4, the method of manufacture includes providing coal oil with anti-bacterial LDPE into the extruded high-density polyethylene. In some embodiments, the anti-bacterial LDPE added may be approximately 0.5% to 3% of the total weight of the combined filament, preferably approximately 0.75% to 2%, and more preferably approximately 1% total weight. In some embodiments, the anti-bacterial LDPE solution may be added to the UHMWPE solution. For example, the anti-bacterial LDPE may be dissolved in the coal oil in an instance in which the coal oil is then added into the extruded UHMWPE at a predetermined temperature.

In some examples, the coal oil with anti-bacterial LDPE may be added into the UHMWPE at a predetermined temperature. In some embodiments, the predetermined temperature of the UHWMPE when the anti-bacterial LDPE is added may be from approximately 80 degrees Celsius to 200 degrees Celsius, preferably approximately 80 degrees Celsius to 160 degrees Celsius, and more preferably approximately 105 degrees Celsius. temperature. In some embodiments, the coal oil may be a shale oil, such as kerosene. In some embodiments, other solvent substances may be used to dissolve the anti-bacterial LDPE, such as decalin.

Referring now to Block 420 of FIG. 4, the method of manufacture includes processing the combined filament using a moderated flow device 530. In various embodiments, the moderated flow device 530 may be configured to extrude the combined filament. In some embodiments, the moderated flow device 530 may be in communication with a spinneret 540 configured to divide the combined filament into a plurality of threads or fibers once the combined filament has been extruded. The speed of the extrusion and subsequent processing through the spinneret 540 may be based on the type of application, the equipment used, the size of the desired fiber, and/or the like. In some embodiments, the threads or fiber generated through the spinneret 540 continue through a bath 550 for coagulation.

Referring now to Block 430 of FIG. 4, the method of manufacture includes passing the combined filament through a bath 550. In various embodiments, the bath 550 may act as a coagulation bath, such that the combined filament may be quenched (e.g., the polymer chains of the combined filament may be quenched). In various embodiments, the bath 550 may contain a quenching liquid, such as water. In some embodiments, the quenching liquid in the bath 550 may be ambient temperature water (e.g., approximately 20 degrees to 30 degrees Celsius). In some embodiments, the bath 550 may contain the second solvent, such as xylene, dichloromethane. In various embodiments, the second solvent may be used to extract the first solvent from the combined filament. In various embodiments, the first solvent may be extracted within the bath 550. In some embodiments, the combined filament may also experience cold drawing within the bath 550. For example, the bath 550 may have one or more rollers configured to feed the combined filament through the bath 550. In some embodiments, the one or more rollers may operate with little to no tension on the combined filaments.

Referring now to Block 440 of FIG. 4, the method of manufacture includes providing heat to the combined filament via an oven 560. In various embodiments, after the combined filament passes through the bath 550, such that the fiber is quenched and the first solvent removed, the fiber may then enter into an oven 560 configured to provide heat to the fiber. In various embodiments, the oven 560 may be configured to remove a portion (e.g., most) of the second solvent from the fiber during the drying process. In various embodiments, the oven 560 may be a special oven configured for the processes described herein. In some embodiments, the oven 560 may be a convection oven.

Referring now to Block 450 of FIG. 4, the method of manufacture includes hot drawing of the filament fibers passing through the oven 560. In some embodiments, the hot drawing may be divided into a plurality of stages. For example, the hot drawing may be divided into three stages, or draws, such that each draw uses a roller to redirect the combined filament within the oven. In various embodiments, the desired heat applied to the fiber may affect the number of draws. In various embodiments, the drawing temperature may be in the range of approximately 110 degrees Celsius to 200 degrees Celsius, preferably approximately 110 degrees Celsius to 160 degrees Celsius, and more preferably approximately 140 degrees Celsius temperature.

Referring now to Block 460 of FIG. 4, the method of manufacture includes winding the finished anti-bacterial fibers 570 on a bobbin (e.g., a spool). In such an embodiment, the anti-bacterial fiber is ready for use, such as in the anti-bacterial glove 100 shown in FIG. 1. In various embodiments, the finished anti-bacterial fiber may be used in similar ways to other fibers are currently used. For example, the anti-bacterial fiber may be used for various applications, such as gloves (e.g., anti-bacterial gloves 100), upper shoe materials, clothing fabrics, ropes, and/or the like. Additionally, the anti-bacterial fiber may be configured with anti-bacterial qualities without any additional steps of manufacturing (e.g., the anti-bacterial fiber itself has anti-bacterial qualities and no additional coating is needed).

Example Manufacturing Process

As shown in FIG. 5, the UHMWPE structure may be added into the extrusion device 510, which extrudes the UHMWPE suspended in a first solvent through a twin screw or the like. The anti-bacterial LDPE may be added to the high-density polyethylene at a predetermined temperature, such as at approximately 110 degrees Celsius. In some embodiments, the anti-bacterial LDPE 200 may be dissolved in an oil 500, such as coal oil. In some embodiments, the oil 500 with the dissolved anti-bacterial LDPE 200 may be combined with the UHMWPE at point 520. Once combined, the combined filament may be passed through a moderated flow device 530 that extrudes the combined filament and passes the combined filament into a spinneret 540 configured to divide the combined filament into individual threading. After the individual threading has been generated by the spinneret 540, the combined filament may be then enter a bath 550, the bath 550 acting as a coagulating bath (e.g., water in the bath that quenches the combined filament) and an extraction bath (e.g., second solvent present in the bath to extract the first solvent). In various embodiments, the combined filament may experience cold drawing within the bath 550. In some embodiments, the combined filament may be passed through an oven 560 in order to dry the combined filament in order to evaporate the second solvent. Additionally, within the oven 560, the filament fibers may experience hot drawing (e.g., to achieve high orientation and high crystallinity of polymer chains) before being spooled for use as an anti-bacterial fiber 570.

Example Bacteria Resistance Test Results

Figure 6A:
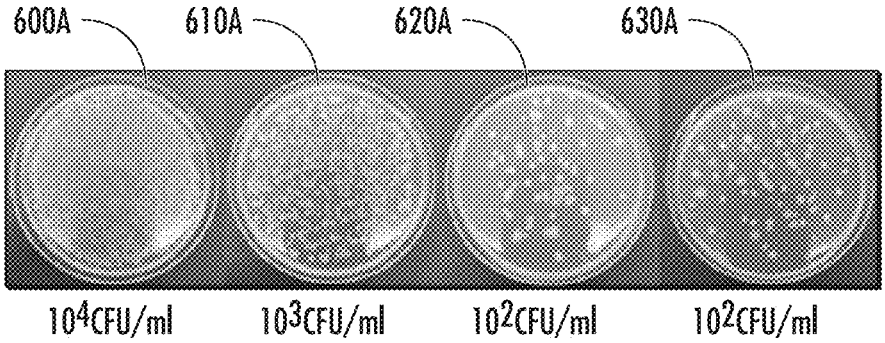
FIGS. 6A and 6B illustrate the bacteria accumulation of a high performance polyethylene fiber without anti-bacterial LDPE (FIG. 6A) and with anti-bacterial LDPE (FIG. 6B) in accordance with an example embodiment.
Figure 6B:
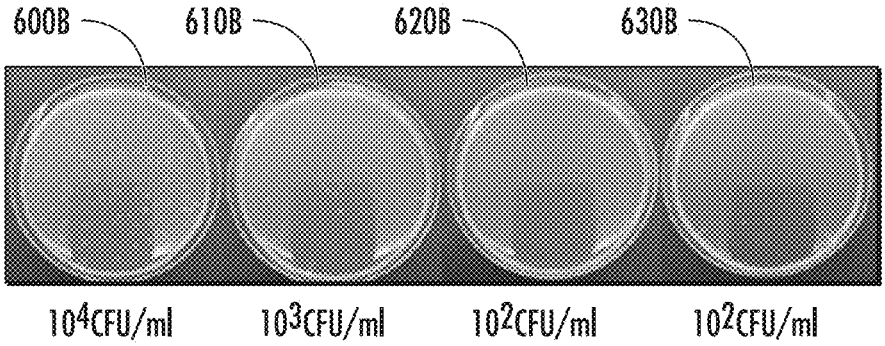

FIGS. 6A-6B illustrates the reduction in bacteria from a typical UHMWPE without the anti-bacterial LDPE. FIG. 6A illustrates the bacteria that accumulates on traditional UHMWPE fiber without the anti-bacterial LDPE included, while FIG. 6B illustrates the bacteria that accumulates on an anti-bacterial fiber in accordance of an example embodiment discussed herein. Both FIGS. 6A and 6B are the results of a GB/T 20944.3-2008 test at various amounts of bacteria. As shown, the traditional UHMWPE fiber (e.g., slides 600A, 610A, 620A, and 630A) may accumulate a large portion of the bacterial passed through the fiber and then exposed to various environments to allow bacteria to grow. In various embodiments, as shown, the amount of bacteria accumulated on the anti-bacterial fiber may be substantially less than the traditional UHMWPE fiber. As shown, in an instance in which the fiber environment allowed for $10^4$ colony-forming unit (CFU)/milliliter (ml) bacteria to be grown, slide 600B illustrates the substantial decrease in bacteria accumulated by anti-bacterial fiber over the traditional UHMWPE fiber, shown in slide 600A. As shown in an instance in which the fiber environment allowed for $10^3$ CFU/ml, slide 610B illustrates the substantial decrease in bacteria accumulated by anti-bacterial fiber over the traditional UHMWPE fiber, shown in slide 610A. As shown in an instance in which the fiber environment allowed for $10^2$ CFU/ml, slide 620B illustrates the substantial decrease in bacteria accumulated by anti-bacterial fiber over the traditional UHMWPE fiber, shown in slide 620A. In another instance in which the fiber environment allowed for $10^2$ CFU/ml, slide 630B illustrates the substantial decrease in bacteria accumulated by anti-bacterial fiber over the traditional UHMWPE fiber, shown in slide 630A. In an example embodiment, the reduction of bacteria accumulation of an anti-bacterial fiber with 1% total weight anti-bacterial LDPE may be approximately 96.6% compared to traditional UHMWPE fiber with no anti-bacterial LDPE.

Embodiments of the present disclosure include anti-bacterial fiber or cloth that may be governed by, tested against, or otherwise relevant to associated standards for bacterial resistance. In some instances, these standards may be defined and/or enforced by standards bodies or government agencies. As would be evident to one of ordinary skill in the art, from time to time these standards may be updated or revised to alter the requirements for satisfying the standard (e.g., in order to reduce injuries or other accidents). By way of example, FIGS. 6A and 6B illustrate the results of a test. Additionally, a bacterial resistance standards may be updated in response to analysis of accident statistics and/or in response to improved technologies. The anti-bacterial fiber structures described herein are comprised of a combination of different techniques for achieving increased bacteria resistance. The use of a combination of techniques rather than simply using one technique may promote achieving a plurality of at least partly antagonistic objectives and/or to balance the properties of a given design. For example, the anti-bacterial fiber may be configured to meet an ASTM E2149 bacteria resistance standard. HMPE yarn made out of anti-bacterial fiber of an example embodiment, when tested using the AATCC 100-2012 test, results in a reduction of over 99.9% for *Escherichia coli* according to the ATCC 8739 standard and over 99.9% reduction for *Staphylococcus aureus* according to the ATCC 6538 standard. Additionally, anti-bacterial fiber of an example embodiment resulted in a reduction of over 99% for *Escherichia coli* according to the ASTM 2149-2013a.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. An anti-bacterial fiber comprising:

an ultra-high molecular weight polyethylene structure; and an anti-bacterial low-density polyethylene (LDPE), wherein the anti-bacterial LDPE comprises polyhexamethylene guanidine (PHMG) grafted to a LDPE structure, wherein the ultra-high molecular weight polyethylene structure and the anti-bacterial LDPE are combined together to form the anti-bacterial fiber.

2. The anti-bacterial fiber of claim 1, wherein the anti-bacterial LDPE is dissolved in an oil.

3. The anti-bacterial fiber of claim 2, wherein the oil that the anti-bacterial LDPE is dissolved comprises coal oil.

4. The anti-bacterial fiber of claim 1, wherein a weight of the anti-bacterial LDPE is approximately 1% of a total weight of the anti-bacterial fiber.

5. The anti-bacterial fiber of claim 1, wherein the ultra-high molecular weight polyethylene structure and the anti-bacterial LDPE are combined using gel-spinning.

6. The anti-bacterial fiber of claim 1, wherein a weight of the anti-bacterial LDPE is 0.5% to 10% of a total weight of the anti-bacterial fiber.

7. The anti-bacterial fiber of claim 1, wherein the ultra-high molecular weight polyethylene structure is extruded through an extrusion device.

8. The anti-bacterial fiber of claim 7, wherein the ultra-high molecular weight polyethylene structure is extruded through the extrusion device before being combined with the anti-bacterial LDPE.

9. The anti-bacterial fiber of claim 1, wherein the ultra-high molecular weight polyethylene structure and the anti-bacterial LDPE are extruded through a moderated flow device.

10. The anti-bacterial fiber of claim 1, wherein the anti-bacterial fiber of claim 1 is configurable into a clothing material.

* * * * *